US005538607A

United States Patent [19]

Pate

[11] Patent Number: 5,538,607

[45] Date of Patent: Jul. 23, 1996

[54] ANODE ASSEMBLY COMPRISING AN ANODE BAR FOR THE PRODUCTION OF MOLTEN METAL BY ELECTROLYSIS

[76] Inventor: Ray H. Pate, 1923 Chestnut Grove Rd., Knosville, Tenn. 37923

[21] Appl. No.: 420,813

[22] Filed: Apr. 12, 1995

[51] Int. Cl.[6] ..... C25C 3/12

[52] U.S. Cl. ..... 204/280; 204/286; 204/297 R

[58] Field of Search ..... 204/279, 280, 204/286, 290 R, 297 R, 243 R; C25C 3/08, 3/10, 3/12, 3/06

[56] References Cited

U.S. PATENT DOCUMENTS

| | | | |
|---|---|---|---|
| 4,269,673 | 5/1981 | Clark | 204/67 |
| 4,347,661 | 9/1982 | Golla | 29/879 |
| 4,557,817 | 12/1985 | Voegel et al. | 204/286 |
| 4,612,105 | 9/1986 | Langon | 204/286 |
| 4,664,760 | 5/1987 | Jarrett | 204/286 |
| 4,720,333 | 1/1988 | Duval et al. | 204/241 |
| 5,268,083 | 12/1993 | Rathgeber et al. | 204/243 R |

*Primary Examiner*—Kathryn Gorgos
*Attorney, Agent, or Firm*—Diller, Ramik & Wight

[57] ABSTRACT

An anode bar is disclosed particularly for utilization during the production of molten metal by the Hall-Héroult process in which an elongated copper rod is slit partially along its length and bent to define a generally inverted ⊕-shaped member defined by a base end portion, a bridging arm and a pair of generally parallel legs. Each leg is received in a sleeve and inserted into a ring with a polygonal opening in the ring matching a polygonal exterior surface of the associated leg. A weld intimately welds each metal ring to each leg end and covers the latter. By this construction, there is an absence of current arcing, consumption of an associated carbon anode or anode block is reduced, as is the consumption of the ring, sleeve and legs, but upon partial consumption of any of the latter restoration is achieved in an efficient and low cost manner.

48 Claims, 2 Drawing Sheets

ANODE ASSEMBLY COMPRISING AN ANODE BAR FOR THE PRODUCTION OF MOLTEN METAL BY ELECTROLYSIS

BACKGROUND OF THE INVENTION

Commercial purity aluminum is the basis for the majority of the normal aluminum alloys. It is often used without any additions, such as in the production of utensils and foil. The production of metallic aluminum from alumina takes place in electrolytic cells or pots at a temperature of approximately 950° C. Direct current is passed through a current-conducting salt bath in which alumina is dissolved. The bath consists of fused sodium aluminum fluoride ($Na_3AlF_6$), commonly called cryolite, or a mixture of cryolite and other fluorides. Because alumina dissolves in the salt bath, the electrolysis takes place considerably under the melting point of alumina (about 2150° C.). Aluminum fluoride, lithium fluoride, calcium fluoride or magnesium fluoride can be added to the bath in order to further lower the melting point and/or vapor pressure.

The typical electrolytic cell comprises a rectangular steel shell lined with refractory material as heat insulation, which in turn is lined with carbon. Carbon blocks in a bottom of the cell serve as the cathode. The cell holds the fuse salt electrolyte in which alumina is dissolved. Carbon anodes are suspended from above the cell and dip into the bath. When the cell is in operation, the bath is kept molten by the heat generated from the passage of electrical current. The surface is usually crusted over. Alumina is added to the bath as needed by breaking the crust. Under the influence of the electric current, aluminum metal is deposited at the negative pole and, therefore, collects at the bottom of the cell from where it is siphoned periodically. Oxygen is released at the anodes where it reacts with carbon, forming CO and $CO_2$. Thus, the anodes and anode bars supporting the anodes in a conventional manner are consumed and must be replaced regularly. It is highly desirable to both prevent anode bars from being consumed rapidly, yet permit rapid restoration, refurbishment and/or replacement when so dictated.

Conventional aluminum reduction plants require a large amount of electrical energy, and by extending the life of electrodes or allowing inexpensive refurbishment thereof, electrical costs are maintained sufficiently low to assure the production of commercially competitive aluminum by increasing power efficiency and associated carbon anode efficiency, a reduction in the price of aluminum can be achieved and is, of course, compounded over time. Such savings involve a great deal of money (in the millions) and high anode efficiency is extremely advantageous under present Hall-Héroult cell processes using consumable anodes.

SUMMARY OF THE INVENTION

The present invention is directed to a novel anode bar for supporting anodes/anode blocks particularly adapted for utilization in present-day Hall-Héroult cell applications for producing molten metal specifically molten aluminum. The anode bar of the present invention evidences a major breakthrough in productivity and power efficiency in existing cells through innovative anode bar design, better control associated therewith, better heat recovery, more efficient use and conversion of raw materials into a pure aluminum end product, and rapid low cost restoration of partially consumed anode bars.

Specifically, the anode bar of the present invention is preferably formed from a copper rod of relatively high electrical conductivity. A metal sleeve of relatively hard electrically conductive material, such as steel, receives an end portion of the copper rod, and a generally annular ring is then slipped over an end of the copper rod. The sleeve has a polygonal opening which matches the polygonal configuration of the copper rod, and the two are united by a weld which generally fills a cavity defined by an axial face of the copper rod and an interior surface defining the polygonal opening of the annular ring. A circumferential weld is also utilized to secure the ring to the sleeve. The latter concentrates electrical power at the end of the copper rod and the ring and efficiently transfers the same through an associated carbon block to the cathode of the cell.

Preferably, the anode bar just described is formed in pairs by cutting or slitting the copper rod longitudinally for part of its length and bending cut end portions to define a generally inverted ⊕-shaped anode defined by a base, a pair of bridging arms and a shoulder joining each bridging arm to a leg with the legs being generally in spaced substantially parallel relationship to each other. A metal sleeve having a cylindrical opening is slipped over each leg and a ring is then slipped over an end of each leg. Each leg has a polygonal exterior surface which is matched by a polygonal opening in each ring. An axial end face of each leg and the polygonal surface of each ring defines a cavity which is filled by a weld to secure legs and the rings together in intimate high electrically-conductive relationship. A circumferential weld also secures each ring to its sleeve and each sleeve is additionally secured by a weld to its associated bridging arm and to a metal reinforcing bar spanning the distance between the sleeves. Carbonaceous material is molded in a conventional manner to form a carbon block or carbon anode encapsulating major portions of the two sleeves thus completing the totality of the anode which is then used in a conventional manner in a Hall-Héroult aluminum smelting cell.

As the carbon of the anode or anode block is progressively consumed, so too might/will the metal rings, the lower end portions of the sleeves and the lower ends of the anode bar legs. However, the consumption/destruction of the ring, sleeve and anode bar leg is reduced tremendously from known anode structures because of (1) the intimate surface-to-surface contact between the exterior polygonal surface of each anode bar leg and its associated ring polygonal opening and (2) the weld within and across these mating polygonal surfaces which collectively define an efficient path of conductivity or electricity flow which is concentrated thereby at the end of each leg, its associated ring and the weld therebetween. Therefore, arcing-over between each rod and its sleeve is virtually eliminated, power is concentrated in the area of the ring and the end of the leg, and conductivity between the latter and the carbon anode or a carbon anode block assures a highly efficient transfer of power to the cell bath.

Because of the latter construction, should the ring and/or end of the leg eventually be consumed to a point at which power efficiency transfer is undesirable diminished, the carbon anode block is removed, any consumed portion of the ring and/or lower end portion of the sleeve and/or lower end portion of the leg is removed, via a cutting torch for example, and a "fresh" end of the leg is exposed. Another metal ring having a polygonal opening corresponding to the exterior polygonal configuration of the "fresh" leg is slipped upon the latter, rewelding both axially and circumferentially is effected, and subsequently another carbon anode block is molded thereto. Thus, the original anode bar is relatively inexpensive to manufacture, is very efficient as a power conductor, yet can be quickly and inexpensively restored when partially consumed to a point at which efficiency has diminished below a desired level.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figure 1:
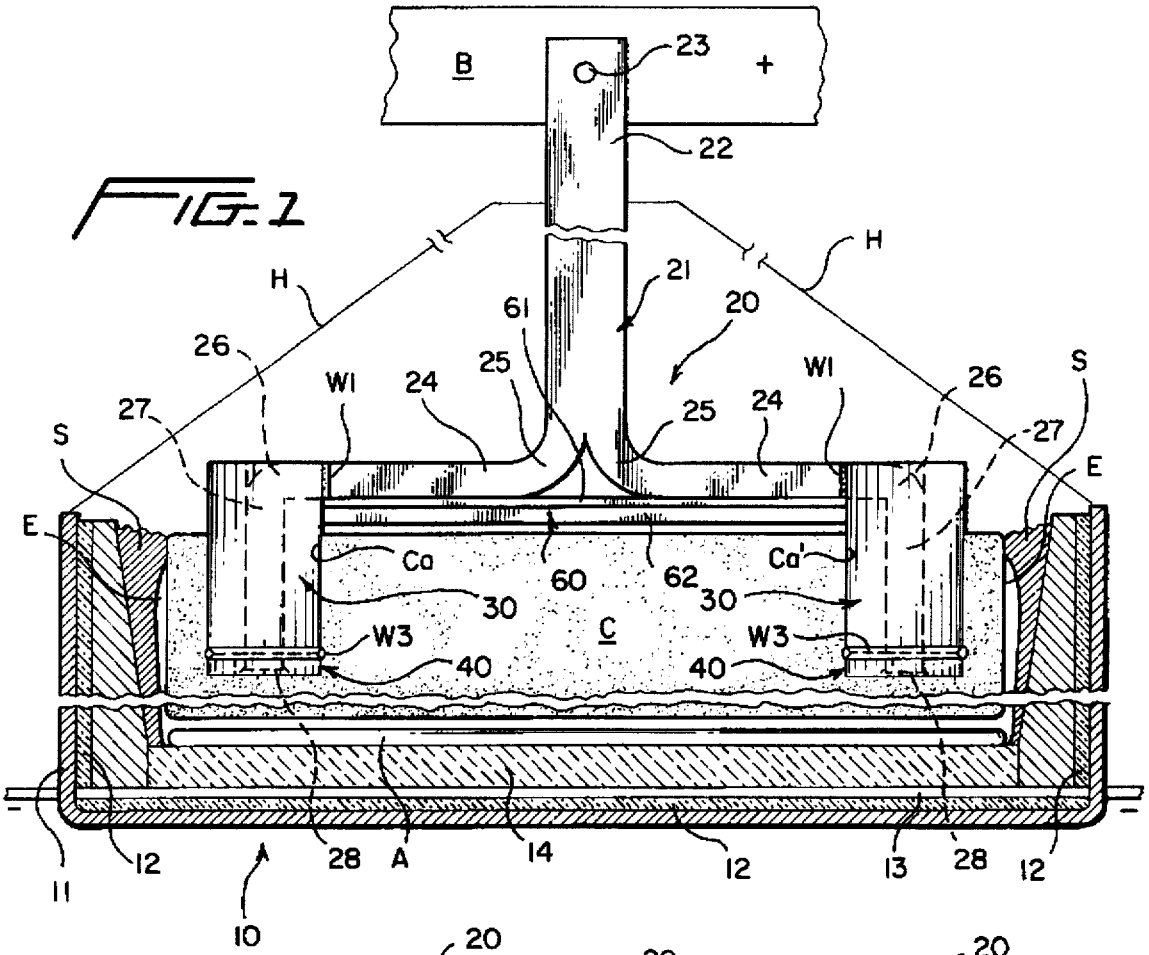
FIG. 1 is a highly schematic fragmentary sectional view taken through a Hall-Héroult aluminum smelting cell, and illustrates an anode bar of the present invention formed of a generally inverted ⊎-shaped configuration defined by a base portion, a pair of bridging arms and a shoulder uniting each bridging arm to a leg with a sleeve and a ring being in externally telescopic relationship to each leg.

An electrolytic Hall-Héroult smelting cell for commercially producing aluminum from alumina is illustrated in FIG. 1 of the drawings and is generally designated by the reference numeral 10.

The electrolytic cell or pot 10 is defined by an exterior steel shell 11 lined internally with insulation 12. A cathode bar 13 is connected to the negative side of a source of electrical power (not shown) and lies beneath a carbon cathode 14. A port (not shown) is provided through which molten aluminum A is periodically siphoned. Molten alumina and cryolite from a conventional electrolyte or an electrolyte bath E within which is at least partially immersed one or more consumable carbon anodes or carbon blocks C with the carbon anode C having cylindrical blind end cavities Ca, Ca'. Solidified alumina and cryolite S forms a crust. The steel shell 11 of the electrolytic cell 10 is covered by a conventional gas collection hood H.

Electricity is conducted to the carbon block C by a novel anode bar or anode support of the present invention which is generally designated by the reference numeral 20 and is specifically adapted for utilization during the production of molten alumina by the Hall-Héroult process.

Figure 2:
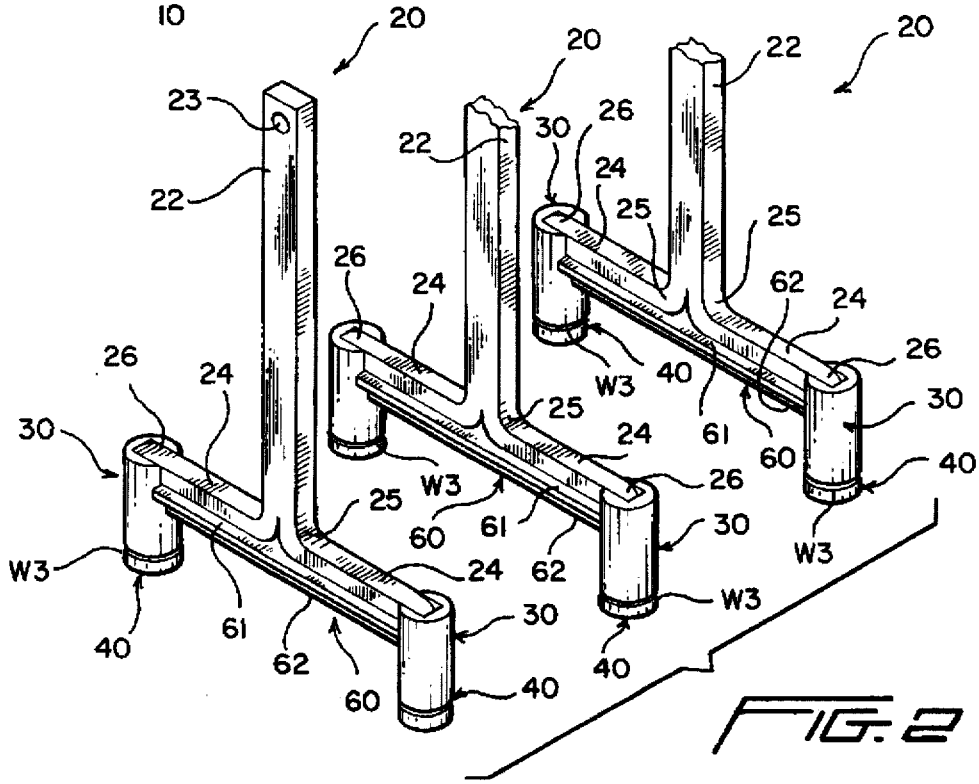
FIG. 2 is a perspective view, and illustrates several of the anode bars of FIG. 1 which can be collectively molded to a single consumable carbon anode block.
Figure 5:
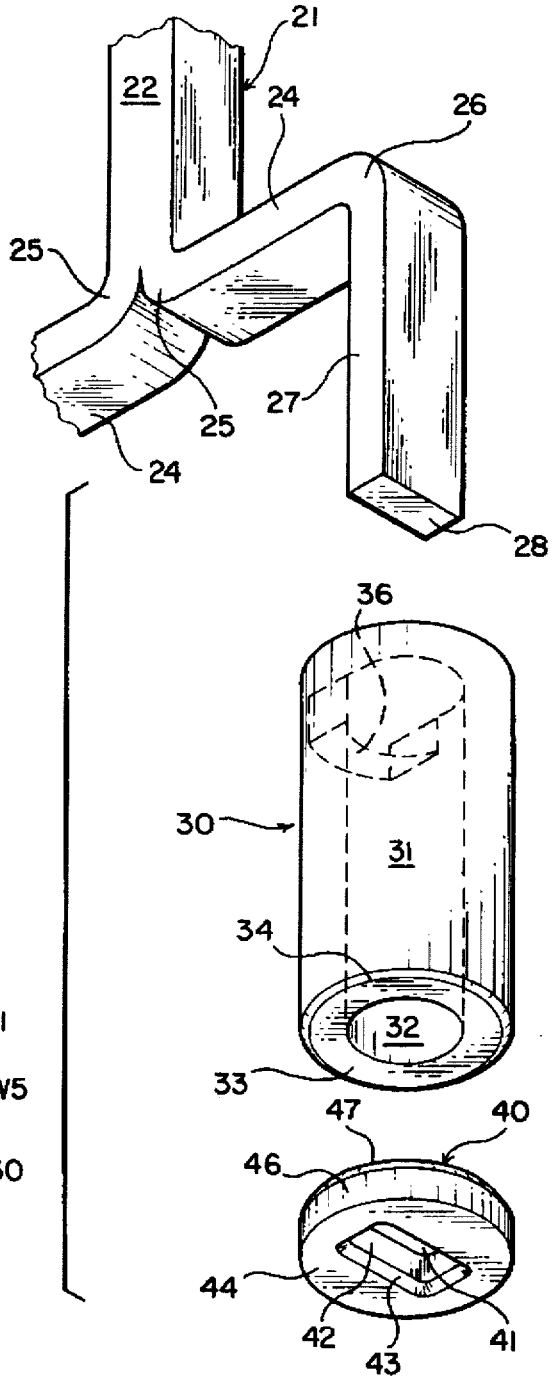
FIG. 5 is an exploded view, and illustrates the anode bar components, namely, the inverted ⊎-shaped copper rod, one cylindrical sleeve having a cylindrical opening, and an annular ring having a polygonal opening matching the polygonal exterior configuration of the copper anode leg.

The anode bar 20 includes a bar or member 21 which originally is a straight length of highly electrically conductive material, such as copper, having a generally rectangular configuration, as is readily apparent from FIGS. 2 and 5. Originally, the rod 21 is approximately 98 inches in length and is of a polygonal configuration of approximately 3"×3". This copper rod is slit medially along its longitudinal axis from one end a distance of approximately 26 inches and is then bent to the generally inverted ⊎-shaped configuration illustrated best in FIGS. 1, 2 and 5 of the drawings. The inverted ⊎-shaped rod is defined by a relatively long (72 inches) base portion or connecting portion 22 having an opening 23 for connection to a conventional anode beam B; bridging arms or bridging portions 24, 24 joined by inner shoulders or radius portions 25 to the base portion 22; outer shoulders or radius portions 26 joined to the bridging arm portions 24, and depending leg portions 27 which are in generally parallel relationship to each other and terminate in axial end faces or surfaces 28.

Figure 3:
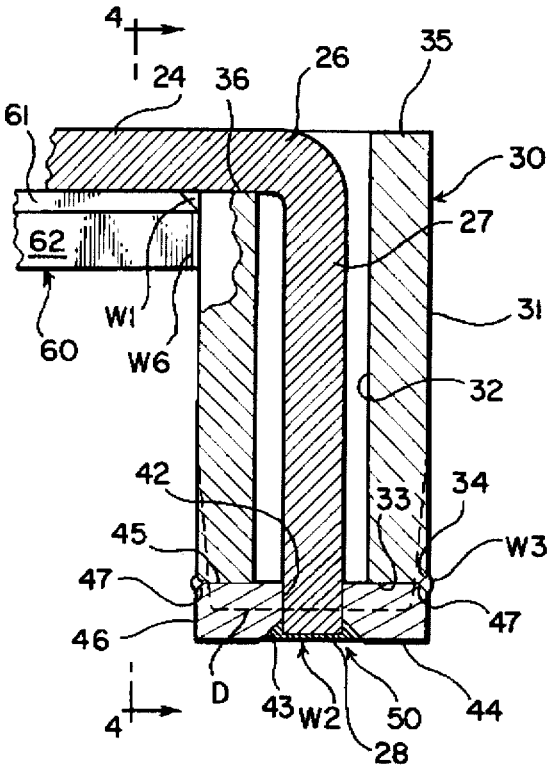
FIG. 3 is an enlarged fragmentary vertical cross-sectional view taken generally through the right-hand leg, sleeve and ring of the anode bar of FIG. 1, and illustrates details of the construction thereof.

A pair of identical relatively hard metallic sleeves 30, such as steel, which are also highly electrically conductive, are each defined by an outer cylindrical surface 31 (FIG. 5), an inner cylindrical surface 32, a lower annular axial end face or surface 33, a chamfer 34 between the surfaces 31, 33, an upper annular axial end or surface 35 and a notch 36 which opens axially through the upper annular end surface 35 and radially through the cylindrical surfaces 31, 32. The diameters of the surfaces 31, 32 are 6" and 3", respectively. Therefore, each leg 27 can be freely telescopically inserted into each sleeve 30, as is best illustrated in FIG. 3, and when so inserted, each arm portion 24 is snugly accommodated in one of the slots 36. Suitable welds W1 (FIGS. 3 and 4) are utilized to weld each steel sleeve 30 to its associated bridging arm portion 24 along the underside (unnumbered) and the side edges (also unnumbered) of the notch 36 to rigidly unify each leg 27 to its associated cylindrical sleeve or stub 30. At this stage in the fabrication of the anode bar 20 the terminal end portion or axial end face 28 of each leg 27 projects beyond the lower annular axial end face 33 of each sleeve 30, as is most readily apparent from FIGS. 3 and 4 of the drawings.

A generally annular metallic ring 40 constructed from relatively hard electrically conductive material, such as steel, has a polygonal opening 41 corresponding in shape and size to the exterior polygonal configuration of each leg 27. Each polygonal opening 41 is defined by a generally polygonal surface 42 (FIG. 5) which matches the exterior polygonal surface (unnumbered) of each of the legs 27 and which merges with a chamfered polygonal surface 43. The chamfered surface 43 terminates at a lower, generally annular, end face or axial surface 44 which is spaced from and is generally parallel to an upper annular end face or axial surface 45 (FIG. 3) between which is a cylindrical surface 46 having an exterior diameter matching the diameter of the exterior surface 31 of each sleeve 30. A peripheral chamfer or chamfered surface 47 lies between the surfaces 45, 46 and matches the chamfer 34 of each sleeve 30.

Each ring 40 is slipped upon one of the legs 27 with each leg 27 being in intimate surface-to-surface contact with the polygonal surface 42 thereof, as is most apparent from FIG. 3. In this position the axial face 28 of each leg 27 is set back from the lowermost end face 44 of each ring 40, as is best illustrated in FIG. 3. The end face 28 of each leg 27 and the chamfer 43 define a cavity or well 50. The end of each leg 27 is welded to the annular ring 40 throughout the entire area of the cavity 50 by a weld W2 which essentially covers the entire end face 28 of each leg 27 and forms an intimate bond between the polygonal surface of each leg 27 and the polygonal surfaces 42, 43 of its associated ring 40, as is best illustrated in FIG. 3. A weld W3 is provided between the chamfered surfaces 34, 45 to unite each ring 40 to each sleeve 30.

Figure 4:
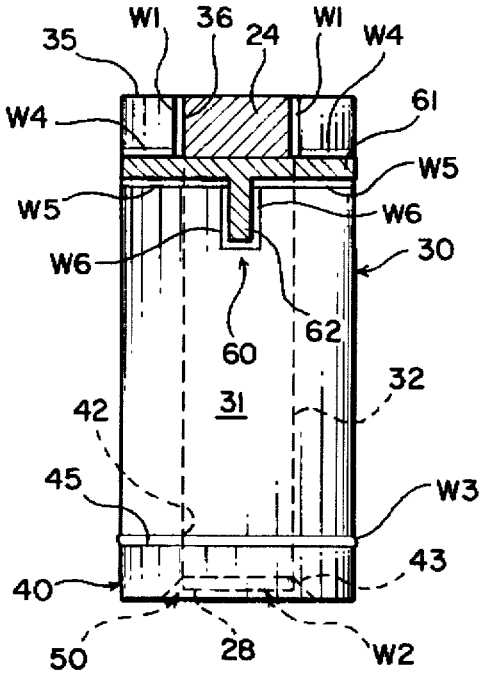
FIG. 4 is a cross-sectional view taken generally along line 4—4 of FIG. 3, and illustrates the bridging arm received in an upwardly and radially opening slot or notch of the sleeve and an associated T-shaped reinforcing member.

Reinforcing means 60 in the form of a generally T-shaped member constructed from relatively strong electrically conductive material, such as steel, bridges the distance between each of the sleeves 30, 30 (FIG. 2) along the underside of the arm portions 24, 24 thereof. The reinforcing means or member 60 is defined by a generally horizontal portion or and 61 and a downwardly projecting vertical portion or rib 62 located substantially half the distance between ends (unnumbered) of the horizontal portion 61, as is best illustrated in FIG. 4. An upper surface (unnumbered) of the horizontal portion 61 underlies and preferably abuts a lower surface (unnumbered) of the bridging arm or bridging arm portions 24, 24. Welds W4 (FIG. 4) weld an upper side (unnumbered) of each horizontal portion 61 to each sleeve 31 and welds W5 weld a lower side (unnumbered) of each horizontal portion 61 to each sleeve 30. A weld W6 along vertical sides and a lower edge (unnumbered) of the vertical portion 62 of each reinforcing member 60 welds the vertical portion 62 thereof to each of the sleeves 30.

The anode bar 20 can now be fused singularly, in pairs, or in groups, as shown in FIG. 2, relative to an associated carbon block or carbon anode C by molding carbonaceous material thereto in the manner illustrated in FIG. 1. Thereafter, the base portions or connecting portions 22 are secured by suitable fasteners, such as bolts and nuts (not shown) to one or more conventional anode beams B (FIG. 1) which are in turn connected to a positive source of electrical power with, of course, the cathode bar 13 being connected to a negative source of electrical power, as earlier described.

During electrolysis in the electrolytic cell 10, the carbon block(s) or anode(s) C is immersed in the electrolyte bath E which is kept molten by the heat generated from the passage of electrical current. Under the influence of the electrical current, the molten aluminum A is deposited adjacent the carbon cathode 14 at the bottom of the electrolytic cell 10 from where it is siphoned periodically through a conventional port (not shown), as was heretofore described. Oxygen is released at the carbon block C and at the anode bar 20 where it reacts with carbon forming CO and $CO_2$, and though the latter is exhausted from beneath the hood H, the anodes C are continuously and progressively consumed and must be replaced regularly. Consumption of the carbon blocks C is dramatically reduced by the present invention because of the construction of the anode bar 20 heretofore described, particularly because of the intimate engagement between each annular ring 40 and the associated end 28 of each leg 27 by virtue of (a) the matching polygonal configuration of the exterior surface of each leg 27 and the interior polygonal surface 42 of each ring 40 and (b) the intimate weld W2 (FIG. 3) which fills the cavity 50, covers the end face 28 of each leg 27, and intimately unites the chamfer surface 42 of each annular ring 40 to the end of each leg 27. Due to the latter construction, current which flows through each bridging arm portion 24, 24, each shoulder 26 and each leg 27 and each sleeve 30 and ring 40 will not disadvantageously arc, particularly across the gap between each leg 27 and the interior cylindrical surface 32 of each sleeve 30, but will instead pass through each leg 27, axially through each end thee 28 and the associated weld W2 and through each annular ring 40 and the associated carbon block C. Therefore, the current flow is extremely efficient absent undesired arcing and the cost of aluminum in pounds per cell day is dramatically reduced. Moreover, as the carbon block C is consumed, so too are surface portions of the sleeves 30, the rings 40 and the welds W2, W3 associated therewith. However, before efficiency is noticeably decreased due to carbon block, sleeves/rings and or weld consumption, it should be particularly noted from FIG. 3 that each anode leg, 27 is protected by the hard steel of the sleeve 30 and ring 40 and the material of the welds W2, W3, and it is not until the latter components have deteriorated appreciably, that the softer copper of the legs 27 can be subject to deterioration. However, should any of the latter substantially occur, restoration is readily and inexpensively achieved by removing the anode bar 20 from the cell 10, breaking the remaining carbon block C associated therewith, and burning/torching off whatever might remain of the ring 40 and/or the sleeve 30. For example, in FIG. 3 a dashed line has been added and is identified by the reference character D to designate outermost portions of the sleeve 30, the annular ring 40 and the leg 27 which may be consumed during the smelting process. The metal to the left and right of the dashed lines associated with the sleeve 30 and beneath the ring 40 and the end of the leg 27 represents metal which has been consumed. Obviously, the welds W2 and W3 are consumed and are thus nonexistent, and the remaining portion of the ring 40 (above the dashed line D) might well simply fall from the remaining end portion of the leg 27. However, if such does not occur or if the welds W3 have not been consumed, these welds W3 can be burned off and the remaining portions of the annular ring 40 can be removed. Furthermore, the lower end portion of the sleeve 30 which has been consumed can also be burned away as might be an end of the remainder of the leg 27. At this point a new ring 40 is slipped upon the leg 27 and secured thereto by welds corresponding to the welds W2, W3. Therefore, by constructing the sleeve 30 of a relatively long length (12 inches, for example), the same can be restored as its lower end portion is consumed by merely cutting away progressively consumed bottom portions thereof and welding thereto new annular rings. An anode bar 20 thus restored when remolded to a carbon block C is just as efficient as when initially fabricated. Accordingly, the anode bar 20 of the present invention is extremely efficient from the standpoint of (a) initial fabrication, (b) use, (c) restoration and (d) reuse.

It should also be particularly noted that since the copper member 21 initially is slit or cut along its longitudinal axis to form the bridging arm portions 24, 24, the entirety of the member 21 is of a single one-piece homogeneous construction which facilitates current flow in as efficient a manner as possible. Thus, arcing between the anode beam B and the cathode bar 13 along the flow path defined by the anode bar 20 is virtually totally eliminated rendering the electrolytic process extremely efficient.

Although a preferred embodiment of the invention has been specifically illustrated and described herein, it is to be understood that minor variations may be made in the apparatus without departing from the spirit and scope of the invention, as defined the appended claims.

I claim:

1. An anode assembly comprising an anode bar particularly adapted for utilization during the production of molten metal by electrolysis, said anode bar being a metal rod of relatively high electrical conductivity, a metal sleeve of relatively hard electrically conductive material, said metal rod having an end portion housed in internal telescopic relationship to said sleeve, means for securing said rod and sleeve together, a carbon block having a cavity, and said metal sleeve being received in said cavity.

2. The anode assembly as defined in claim 1 including means for closing an end of said sleeve contiguous a terminal end of said metal rod end portion.

3. The anode assembly as defined in claim 1 wherein said securing means is a weld.

4. The anode assembly as defined in claim 1 wherein a terminal end of said metal rod projects beyond said metal sleeve.

5. The anode assembly as defined in claim 1 wherein a terminal end of said metal rod projects beyond said metal sleeve, and an annular metal ring encircling said metal rod terminal end.

6. The anode assembly as defined in claim 5 wherein said securing means includes a weld securing said annular ring to said sleeve.

7. The anode assembly as defined in claim 5 wherein said securing means includes a circumferential weld securing said annular ring to said sleeve.

8. The anode assembly as defined in claim 1 wherein a terminal end of said metal rod projects beyond said metal sleeve, an annular metal ring encircling said metal rod terminal end, and said securing means secure said annular metal ring to said metal rod terminal end.

9. The anode assembly as defined in claim 8 wherein said securing means includes a weld securing said annular ring to said sleeve.

10. The anode assembly as defined in claim 1 wherein a terminal end of said metal rod projects beyond said metal sleeve, an annular metal ring encircling said metal rod terminal end, said securing means secure said annular metal ring to said metal rod terminal end, and said securing means is a weld in and closing an opening defined by said annular metal ring.

11. The anode assembly as defined in claim 10 wherein said securing means includes a weld securing said annular ring to said sleeve.

12. An anode assembly as defined in claim 1 wherein said metal rod having an exterior polygonal surface, said metal sleeve having an interior cylindrical surface, said metal ring having an interior polygonal surface defining a polygonal opening substantially matching the exterior polygonal surface of said metal rod having an end portion in internal telescopic relationship to said metal sleeve and said metal ring, and means for securing said metal rod, sleeve and ring together.

13. The anode assembly as defined in claim 12 wherein said securing means includes weld means.

14. The anode assembly as defined in claim 12 wherein said securing means includes weld means between said ring and rod end portion.

15. The anode assembly as defined in claim 12 wherein said securing means includes weld means between said ring and rod end portion and at least partially filling a cavity between an axial end face of said rod end portion and said ring interior polygonal surface.

16. The anode assembly as defined in claim 12 wherein said securing means includes weld means between said ring and sleeve.

17. The anode assembly as defined in claim 12 wherein said securing means includes weld means between said ring and rod end portion, and between said ring and sleeve.

18. The anode assembly as defined in claim 17 wherein said weld means at least partially fills a cavity between an axial end face of said rod end portion and said ring interior polygonal surface.

19. An anode assembly as defined in claim 1 wherein said metal rod having a first end portion connected to a source of current and an opposite second end portion terminating in a terminal end, a metal sleeve of relatively hard electrically conductive material having axially opposite first and second terminal ends, said metal rod second end portion being housed in internal telescopic relationship to said sleeve with said metal rod second end portion terminal end being contiguous to said metal sleeve first terminal end, and weld means for securing said metal rod second end portion terminal end and said metal sleeve first terminal end together.

20. The anode assembly as defined in claim 19 wherein said metal rod includes a medial portion between said metal rod first and second end portions, and said metal rod medial portion is disposed generally transverse to said metal rod first and second end portions.

21. The anode assembly as defined in claim 20 including a bent radius portion between said metal rod medial portion and each of said metal rod first and second end portions.

22. The anode assembly as defined in claim 19 wherein said metal rod includes a medial portion between said metal rod first and second end portions, and said metal rod medial portion is disposed generally normal to said metal rod first and second end portions.

23. The anode assembly as defined in claim 22 including a bent radius portion between said metal rod medial portion and each of said metal rod first and second end portions.

24. An anode assembly as defined in claim 1 wherein said metal rod having a first end portion connected to a source of current and an opposite second end portion terminating in a terminal end, a metal sleeve of relatively hard electrically conductive material having axially opposite first and second terminal ends, said metal rod second end portion being housed in internal telescopic relationship to said sleeve with said metal rod second end portion terminal end being contiguous to said metal sleeve first terminal end, weld means for securing said metal rod second end portion terminal end and said metal sleeve first terminal end together, a carbon block having a cavity, and said metal sleeve being received in said cavity.

25. An anode assembly as defined in claim 1 wherein said metal rod having a first end portion connected to a source of current and an opposite second end portion terminating in a terminal end, a metal sleeve of relatively hard electrically conductive material having axially opposite first and second terminal ends, said metal rod second end portion being housed in internal telescopic relationship to said sleeve with said metal rod second end portion terminal end being contiguous to said metal sleeve first terminal end, and weld means for securing said metal rod second end portion terminal end and said metal sleeve first terminal end together through the intermediary of an annular metal ring.

26. An anode assembly comprising an anode bar particularly adapted for utilization during the production of molten metal by electrolysis, said anode bar being a metal rod of relatively high electrical conductivity, said metal rod including at least a pair of end portions, at least a pair of metal sleeves of relatively hard electrically conductive material, said rod end portions being each in internal telescopic relationship to one of said sleeves, means for securing each rod end portion to its associated sleeve, a carbon block having cavities, and each metal sleeve being received in one of said cavities.

27. The anode assembly as defined in claim 26 wherein said rod end portions are defined by cutting said rod longitudinally a preset distance along its length.

28. The anode assembly as defined in claim 26 wherein said sleeves are in relatively spaced relationship, and means connected between said sleeves for rigidifying the same.

29. The anode assembly as defined in claim 26 wherein said sleeves are in substantially spaced parallel relationship to each other.

30. The anode assembly as defined in claim 26 wherein said rod end portions are each joined by a shoulder portion to a bridging arm, each sleeve is defined by a substantially cylindrical wall, each cylindrical wall includes an axially upwardly and radially inwardly and outwardly opening groove, and a portion of said bridging arm adjacent each shoulder is seated in an associated groove.

31. The anode assembly as defined in claim 30 wherein said rod end portions are defined by cutting said rod longitudinally a preset distance along its length.

32. The anode assembly as defined in claim 30 wherein said sleeves are in relatively spaced relationship, and means connected between said sleeves for rigidifying the same.

33. The anode assembly as defined in claim 30 wherein said sleeves are in substantially spaced parallel relationship to each other.

34. The anode assembly as defined in claim 26 wherein said sleeve includes an internal cylindrical surface, each said rod end portions includes an external polygonal surface, and said securing means includes an annular ring having an interior polygonal surface in external substantially mating relationship to one of rod end portions polygonal surface.

35. The anode assembly as defined in claim 34 wherein said rod end portions are defined by cutting said rod longitudinally a preset distance along its length.

36. The anode assembly as defined in claim 34 wherein said sleeves are in relatively spaced relationship, and means connected between said sleeves for rigidifying the same.

37. The anode assembly as defined in claim 34 wherein said sleeves are in substantially spaced parallel relationship to each other.

38. The anode assembly as defined in claim 26 wherein said sleeve includes an internal cylindrical surface, each said rod end portions includes an external polygonal surface, said securing means includes an annular ring having an interior polygonal surface in external substantially mating relationship to one of rod end portions polygonal surface and said securing means further includes a weld securing each rod end portion to its associated annular ring and substantially filling a cavity defined by an axial end face of each rod and portion and the associated annular ring interior polygonal surface.

39. The anode assembly as defined in claim 38 wherein said rod end portions are defined by cutting said rod longitudinally a preset distance along its length.

40. The anode assembly as defined in claim 38 wherein said sleeves are in relatively spaced relationship, and means connected between said sleeves for rigidifying the same.

41. The anode assembly as defined in claim 38 wherein said sleeves are in substantially spaced parallel relationship to each other.

42. The anode assembly as defined in claim 26 wherein said sleeve includes an internal cylindrical surface, each said rod end portions includes an external polygonal surface, said securing means includes an annular ring having an interior polygonal surface in external substantially mating relationship to one of rod end portions polygonal surface, and said securing means includes a circumferential weld securing each annular ring to its associated sleeve.

43. The anode assembly as defined in claim 26 wherein said sleeve includes an internal cylindrical surface, each said rod end portions includes an external polygonal surface, said securing means includes an annular ring having an interior polygonal surface in external substantially mating relationship to one of rod end portions polygonal surface said securing means further includes a weld securing each rod end portion to its associated annular ring and substantially filling a cavity defined by an axial end face of each rod end portion and the associated annular ring interior polygonal surface, and said securing means further includes a circumferential weld securing each annular ring to its associated sleeve.

44. An anode assembly particularly adapted for utilization during the production of molten metal by electrolysis comprising a metal rod of relatively high electrical conductivity, said metal rod including a first end portion connected to a source of current and an adjoining portion slit along its length to define a pair of second end portions each joined by a medial portion to said first end portion, a bent radius portion between each medial portion and said first end portion and between each medial portion and each second end portion, said medial portions being disposed in transverse relationship to said first end portion and to said second end portions, a pair of metal sleeves of relatively hard electrically conductive material having axially opposite first and second terminal ends, each metal rod second end portion being housed in internal telescopic relationship to an associated one of said sleeves, and weld means for securing a terminal end of each of said metal rod second end portions to one of the first and second terminal ends of the associated metal sleeve.

45. The anode assembly as defined in claim 44 wherein said metal bar second end portions each has a transverse cross sectional configuration and area dissimilar to the transverse cross sectional configuration and area of a bore defined by an internal surface of each sleeve.

46. The anode assembly as defined in claim 45 including an annular metal ring encircling each metal assembly second end portion, and said weld means is at least located in part within each annular metal ring.

47. The anode bar as defined in claim 45 including an annular metal ring encircling each metal bar second end portion, and said weld means is at least located in part within each annular metal ring and covers each metal rod second end portion terminal end.

48. An anode assembly particularly adapted for utilization during the production of molten metal by electrolysis comprising a metal rod of relatively high electrical conductivity, said metal rod including a first end portion connected to a source of current and an adjoining portion slit along its length to define a pair of second end portions each joined by a medial portion to one of said first end portions, a bent radius portion between each medial portion and said first end portion and between each medial portion and each second end portion, said medial portions being disposed in transverse relationship to said first end portion and to said second end portions, a pair of metal sleeves of relatively hard electrically conductive material having axially opposite first and second terminal ends, each metal rod second end portion being housed in internal telescopic relationship to an associated one of said sleeves, weld means for securing a terminal end of each of said metal rod second end portions to one of the first and second terminal ends of the associated metal sleeve, a carbon block having cavities, and each metal sleeve being received in one of said cavities.

* * * * *